US008915383B2

(12) United States Patent
Pedersen et al.

(10) Patent No.: US 8,915,383 B2
(45) Date of Patent: Dec. 23, 2014

(54) READY-TO-ASSEMBLE PLANT STAND

(75) Inventors: Sara L. Pedersen, Minneapolis, MN (US); Samuel J. Clavette, Stillwater, MN (US); Daiying Huang, Medina, MN (US); Stephanie A. Grotta, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 221 days.

(21) Appl. No.: 13/397,089

(22) Filed: Feb. 15, 2012

(65) Prior Publication Data

US 2013/0206714 A1 Aug. 15, 2013

(51) Int. Cl.
*A47F 5/13* (2006.01)

(52) U.S. Cl.
USPC ..... 211/85.23; 211/149; 211/195

(58) Field of Classification Search
CPC ..... A47G 7/041; A47F 5/13; A47F 5/132; A47F 5/135; A47B 43/00; A47B 87/001; A47B 87/02
USPC ..... 211/85, 85.23, 149, 186, 85.31, 195, 211/200, 201, 181.1, 126.7, 133.2, 133.5; 108/97, 98, 99, 100, 101; 47/39; 206/505, 517
See application file for complete search history.

(56) References Cited

U.S. PATENT DOCUMENTS

| | | | | | |
|---|---|---|---|---|---|
| 412,146 | A | | 10/1889 | Whitehouse | |
| 413,745 | A | | 10/1889 | Westphal | |
| D21,044 | S | | 9/1891 | Peters | |
| 462,674 | A | * | 11/1891 | Whitehouse | 108/101 |
| D23,906 | S | | 12/1894 | Symonds | |
| 776,282 | A | * | 11/1904 | Weston | 108/163 |
| 1,125,194 | A | * | 1/1915 | Sigmund | 108/100 |
| 1,146,488 | A | | 7/1915 | Finkelstein | |
| 1,320,310 | A | * | 10/1919 | Brady | 108/100 |
| 1,514,055 | A | * | 11/1924 | Lawson | 108/100 |
| 1,580,061 | A | * | 4/1926 | Lund | 108/100 |
| 1,648,025 | A | * | 11/1927 | Molloy | 206/511 |
| 1,769,190 | A | | 7/1930 | Rush | |
| 1,797,956 | A | * | 3/1931 | Handel | 108/100 |
| 1,915,625 | A | * | 6/1933 | Smith | 211/85 |

(Continued)

OTHER PUBLICATIONS

The Worm that Turned, "Aged Metal Etagere," p. 6, http://www.worm.co.uk/products/aged-metal-etagere (last visited Sep. 6, 2011).

(Continued)

*Primary Examiner* — Jonathan Liu
*Assistant Examiner* — Stanton L Krycinski
(74) *Attorney, Agent, or Firm* — Nixon & Vanderhye P.C.

(57) ABSTRACT

A plant stand includes a first support having a first tier, a second tier and a third tier and a second support having a first tier that corresponds with the first tier of the first support, a second tier that corresponds with the second tier of the first support and a third tier that corresponds with the third tier of the first support. The third tier of the second support has a height that is substantially equal to a height of the third tier of the first support. The plant stand also includes a plurality of shelves. The height of the third tiers substantially corresponds to a length of each shelf. In addition, the first support, the second support and the plurality of shelves are configured into one of a flat pack state having a flat pack height and an assembled state having an assembled height.

14 Claims, 7 Drawing Sheets

(56) References Cited

U.S. PATENT DOCUMENTS

| | | | | | |
|---|---|---|---|---|---|
| 2,483,263 | A | | 9/1949 | Cummings | |
| 2,648,442 | A | | 8/1953 | Lowmaster | |
| 2,799,401 | A | * | 7/1957 | Duchin | 108/181 |
| 2,950,825 | A | * | 8/1960 | Averill | 211/126.8 |
| 3,091,345 | A | * | 5/1963 | Hoose et al. | 108/163 |
| 3,435,958 | A | * | 4/1969 | Chesley | 211/133.2 |
| 3,974,894 | A | * | 8/1976 | Wenger et al. | 182/113 |
| D244,982 | S | | 7/1977 | Parra | |
| 4,615,277 | A | * | 10/1986 | de la Haye | 108/101 |
| 4,691,832 | A | | 9/1987 | Steiger | |
| 4,978,013 | A | * | 12/1990 | Hogg | 211/133.2 |
| 4,991,344 | A | | 2/1991 | Carney | |
| D319,356 | S | | 8/1991 | Vukelich, Sr. | |
| 5,170,897 | A | * | 12/1992 | Wentworth | 211/181.1 |
| D351,072 | S | | 10/1994 | Emalfarb et al. | |
| 5,381,873 | A | * | 1/1995 | Kniefel et al. | 182/152 |
| D367,375 | S | | 2/1996 | Vukelich, Sr. | |
| 5,570,540 | A | * | 11/1996 | Womack et al. | 47/39 |
| 5,692,445 | A | * | 12/1997 | Winer | 108/100 |
| 5,913,270 | A | * | 6/1999 | Price | 108/101 |
| D440,793 | S | | 4/2001 | Iannaccone | |
| D459,908 | S | | 7/2002 | Sharpton, III | |
| 6,659,294 | B1 | * | 12/2003 | Simard | 211/181.1 |
| D505,030 | S | | 5/2005 | Heath et al. | |
| D538,058 | S | | 3/2007 | Van Es | |
| D550,983 | S | | 9/2007 | Van Es | |
| D557,936 | S | | 12/2007 | Van Es | |
| D637,835 | S | | 5/2011 | Molayem | |
| 8,196,761 | B2 | * | 6/2012 | Morandi | 211/186 |
| 2002/0029517 | A1 | * | 3/2002 | Hutchinson et al. | 47/39 |
| 2005/0236351 | A1 | * | 10/2005 | Curatolo | 211/186 |
| 2010/0288717 | A1 | * | 11/2010 | Morandi | 211/187 |
| 2011/0220603 | A1 | * | 9/2011 | Morandi | 211/186 |
| 2012/0111819 | A1 | * | 5/2012 | Chung et al. | 211/195 |

OTHER PUBLICATIONS

Grandinroad, "Set of Three Metal Nesting Tables," 1 page, http://www.grandinroad.com/ProductSearch?storeId=11103&catalogId=11103&langId=-1&searchTerm=nesting+plant+stands (last visited Feb. 14, 2012).

* cited by examiner

READY-TO-ASSEMBLE PLANT STAND

BACKGROUND

A plant stand is a piece of furniture that lifts potted plants and flowers off the floor or off the ground. Plant stands provide a structure for arranging potted plants or flowers to receive more sunlight, be more accessible for watering and pruning and be visually displayed in an aesthetically appealing way.

Flat pack furniture is a type of furniture that is shipped or transported in disassembled components and is capable of being assembled after shipping.

The discussion above is merely provided for general background information and is not intended to be used as an aid in determining the scope of the claimed subject matter.

SUMMARY

A plant stand includes a first support having a first tier, a second tier and a third tier and a second support having a first tier that corresponds with the first tier of the first support, a second tier that corresponds with the second tier of the first support and a third tier that corresponds with the third tier of the first support. The third tier of the second support has a height that is substantially equal to a height of the third tier of the first support. The plant stand also includes a plurality of shelves. The heights of the third tiers substantially correspond to a length of each shelf. In addition, the first support, the second support and the plurality of shelves are configured into one of a flat pack, ready-to-assemble, state having a flat pack height and an assembled state having an assembled height.

To convert the plant stand from the flat pack state to the assembled state, the first support having a plurality of first panels is unfolded and the second support having a plurality of second panels is unfolded. A first end of an elongated back support is fastened to a rearwardmost first panel of the first support, which includes the height of the third tier of the first support, and a second end of the elongated back support is fastened to a rearwardmost second panel of the second support, which includes the height of the third tier of the second support. The elongated back support establishes a spaced distance between the first support and the second support. Each of the plurality of shelves are attached to top components of each corresponding first panels and second panels of the first support and the second support.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

Embodiments of the disclosure describe a ready-to-assemble plant stand that can be shipped or transported in a flat pack configuration and assembled after receipt using simple tools. The ready-to-assemble plant stand includes at least three types of components: a plurality of substantially identical shelves, two substantially identical foldable side supports and a back support. The heights of the foldable side supports substantially correspond with the length of the shelves. When assembled, the shelves of the ready-to-assemble plant stand are tiered. In the flat pack configuration, the ready-to-assemble plant stand has a height that is at least 75% smaller than its height in the assembled state.

Figure 1:
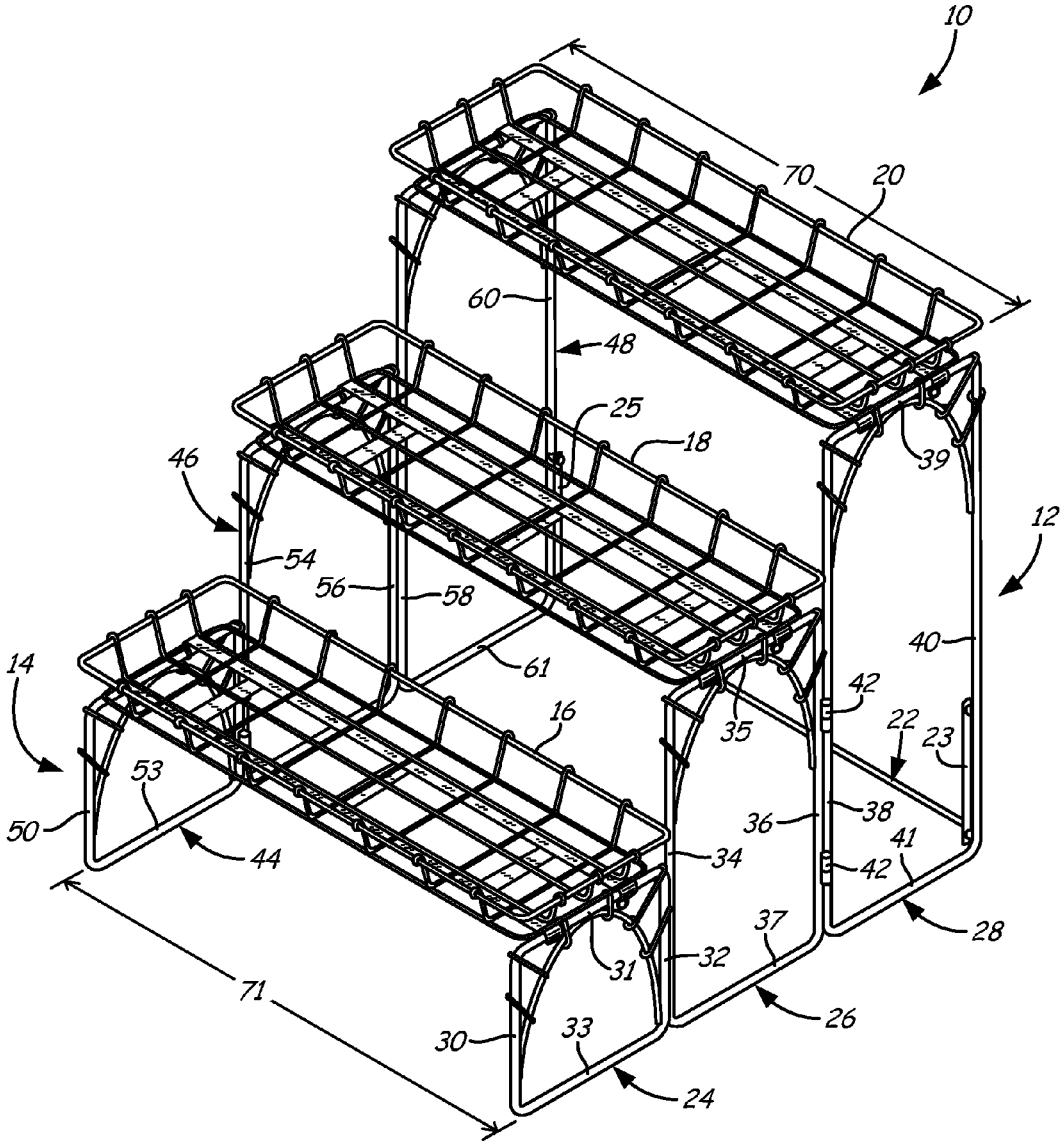
FIG. 1 illustrates a perspective view of a plant stand in an assembled state in accordance with one embodiment.

FIG. 1 illustrates a perspective view and FIGS. 2-7 illustrate orthogonal views of the ready-to-assemble plant stand 10 in an assembled state according to one embodiment. Ready-to-assemble plant stand 10 includes a first foldable assembly or first support 12, a second foldable assembly or second support 14 that is substantially identical to the first foldable assembly 12, a plurality of shelves including a first shelf 16, a second shelf 18 and a third shelf 20 and an elongated back support 22. As illustrated in FIGS. 1-7, the plurality of shelves are a plurality of open top baskets that can be made of pieces of metal wire that are bent, wrapped and welded to form various shapes.

First foldable assembly or first support 12 includes a first panel or forwardmost panel 24, a second panel or center panel 26 and a third panel or rearwardmost panel 28. First panel 24 includes a front component 30, a top component 31, a back component 32 and a bottom component 33 that are made of a single, continuous material including for example metal or metal wire that can be bent, wrapped and welded to form various shapes. Second panel 26 includes a front component 34, a top component 35, a back component 36 and a bottom component 37 that are made of a single, continuous material including for example metal or metal wire that can be bent, wrapped and welded to form various shapes. Third panel 28 includes a front component 38, a top component 39, a back component 40 and a bottom component 41 that are made of a single, continuous material including for example metal or metal wire that can be bent, wrapped and welded to form various shapes As shown, arc-shaped support members may be connected with the front component, the top component, and the back component of the panels. First foldable assembly or first support 12 includes three tiers. The first tier is provided by top component 31 of first panel 24. The second tier is provided by top component 35 of second panel 26. The third tier is provided by top component 39 of third panel 28.

Figure 2:
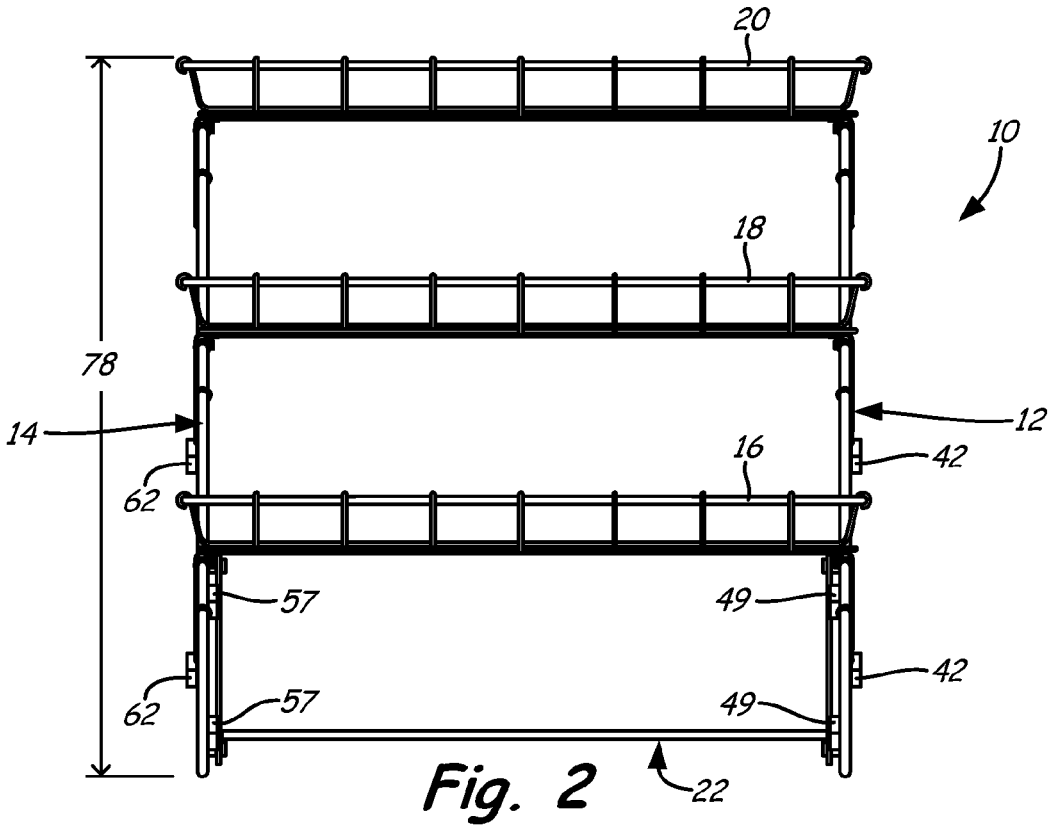
FIG. 2 illustrates a front view of the assembled plant stand illustrated in FIG. 1.

Back component 32 of first panel 24 is rotatably coupled to front component 34 of second panel 26 with a pair of hinges 49 (illustrated in FIG. 2). Hinges 49 couple first panel 24 to second panel 26 of first foldable assembly or first support 12 and face inwardly so that an outer facing surface of first panel 24 and an outer facing surface of second panel 26 face away from each other when folded. Front component 38 of third panel 28 is rotatably coupled to back component 36 of second panel 26 with a pair of hinges 42. The hinges 42 coupling third panel 28 to second panel 26 face outwardly so that an inner facing surface of second panel 26 and an inner facing surface of third panel 28 face away from each other when folded.

Second foldable assembly 14 includes a first panel or forwardmost panel 44, a second panel or center panel 46 and a third panel rearwardmost panel 48. First panel 44 includes a front component 50, a top component 51, a back component 52 and a bottom component 53 made from a single, continuous material including for example metal or metal wire that can be bent, wrapped and welded to form various shapes. Second panel 46 includes a front component 54, a top component 55, a back component 56 and a bottom component 57 made from a single, continuous material including for example metal or metal wire that can be bent, wrapped and welded to form various shapes. Third panel 48 includes a front component 58, a top component 59, a back component 60 and a bottom component 61 made from a single, continuous material including for example metal or metal wire that can be bent, wrapped and welded to form various shapes As shown, arc-shaped support members may be connected with the front component, the top component, and the back component of the panels. First foldable assembly or second support 14 includes three tiers. The first tier is provided by top component 51 of first panel 44 and corresponds with the first tier of the first foldable assembly or first support 12. The second tier is provided by top component 55 of second panel 46 and corresponds with the second tier of the first foldable assembly or first support 12. The third tier is provided by top component 59 of third panel 48 and corresponds with the third tier of the first foldable assembly or first support 12.

Figure 4:
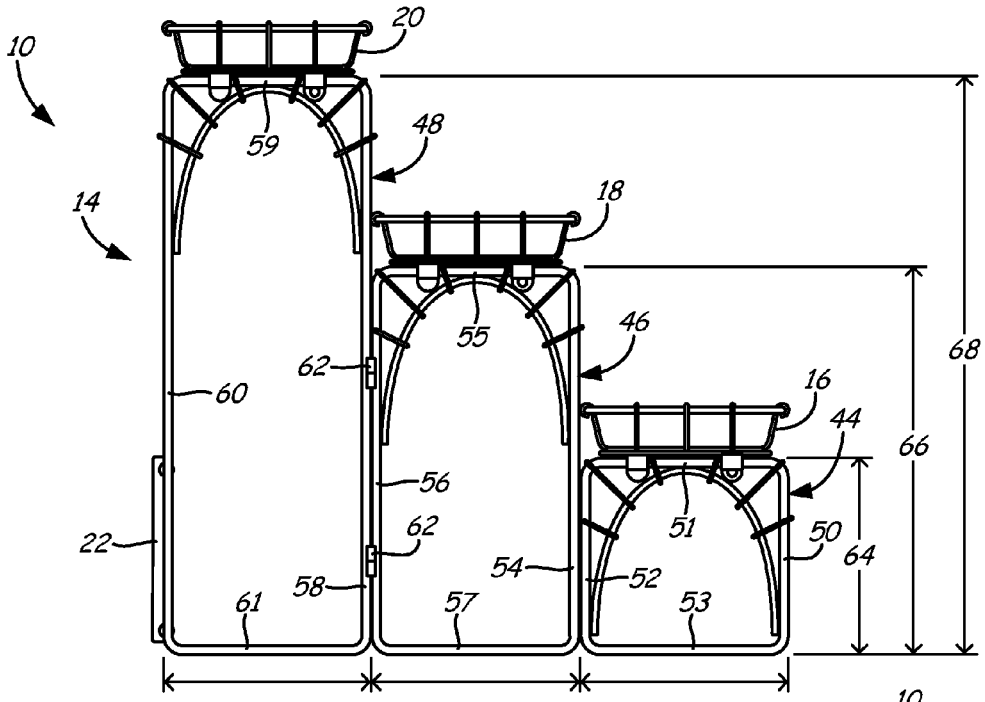
FIG. 4 illustrates a left side view of the assembled plant stand illustrated in FIG. 1.

Back component 52 of first panel 44 is rotatably coupled to front component 54 of second panel 46 with a pair of hinges 57. The hinges 57 coupling first panel 44 to second panel 46 of second foldable assembly or second support 14 face inwardly so that an outer facing surface of first panel 44 and an outer facing surface of second panel 46 face away from each other when folded. Front end 58 of third panel 48 is rotatably coupled to back component 56 of second panel 46 with a pair of hinges 62 (FIG. 4). The hinges 62 coupling third panel 48 to second panel 46 face outwardly so that an inner facing surface of second panel 46 and an inner facing surface of third panel 48 face away from each other when folded.

Figure 5:
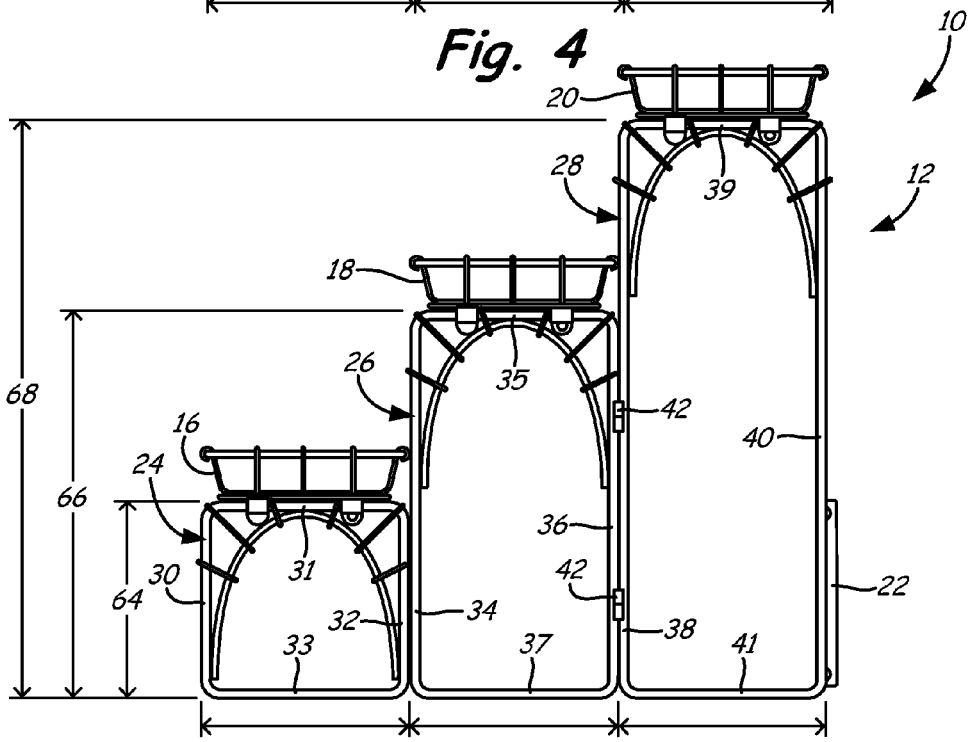
FIG. 5 illustrates a right side view of the assembled plant stand illustrated in FIG. 1.
Figure 6:
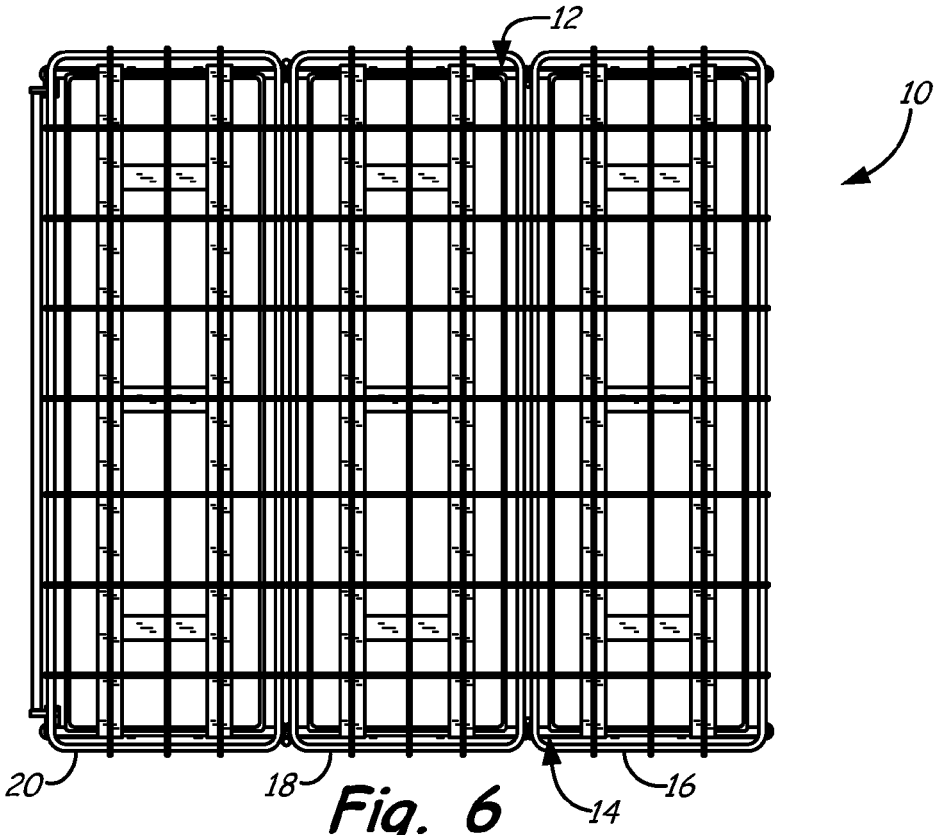
FIG. 6 illustrates a top view of the assembled plant stand illustrated in FIG. 1.
Figure 7:
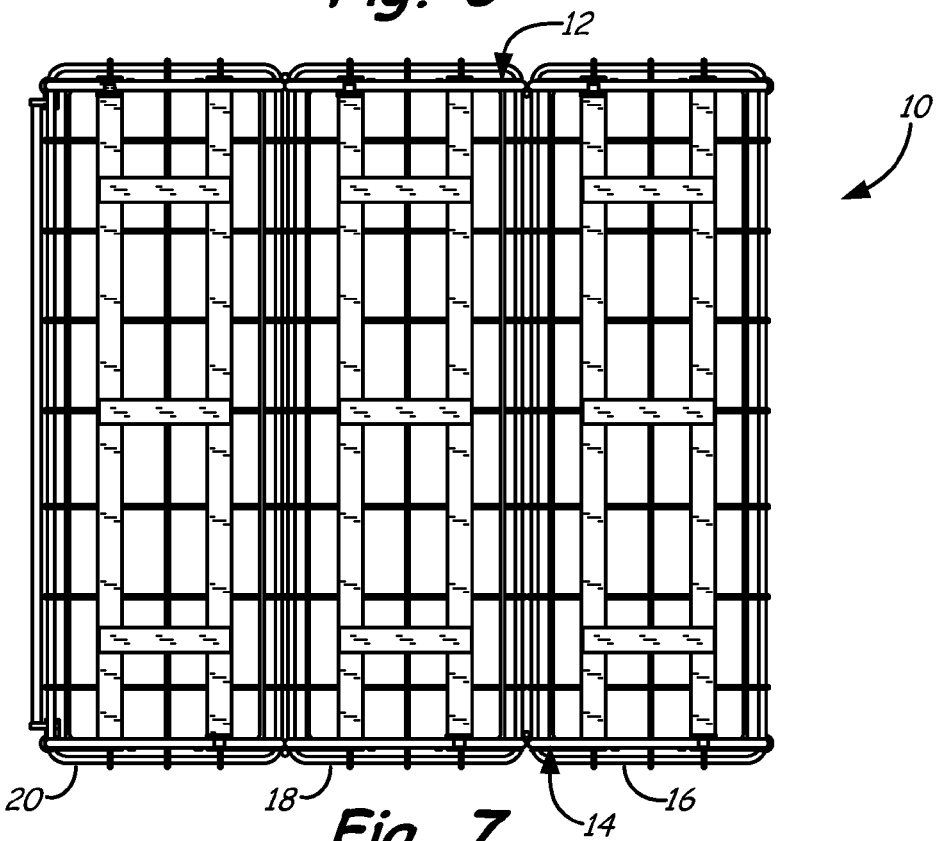
FIG. 7 illustrates a bottom view of the assembled plant stand illustrated in FIG. 1.

Both first panel or forwardmost panel 24 of first foldable assembly or first support 12 and first panel or forwardmost panel 44 of second foldable assembly or second support 14 include a first panel height 64 (FIGS. 4 and 5). Height 64 is the height of the first tier of plant stand 10 and can range between approximately 150 and 200 mm. More specifically, height 64 can be approximately 176 mm. Both second panel or center panel 26 of first foldable assembly or first support 12 and second panel or center panel 46 of second foldable assembly or second support 14 include a second panel height 66 (FIGS. 4 and 5). Height 66 is the height of the second tier of plant stand 10 and can range between approximately 320 and 370 mm. More specifically, height 66 can be approximately 348 mm. Both third panel or rearwardmost panel 28 of first foldable assembly or first support 12 and third side panel or rearwardmost panel 48 of second foldable assembly or second support 14 include a third panel height 68 (FIGS. 4 and 5). Height 68 is the height of the third tier or tallest tier of plant stand 10 and can range between approximately 500 and 550 mm. More specifically, height can be approximately 520 mm. First panel height 64 is less than second panel height 66, which is less than third panel height 68.

Each of the plurality of shelves including first shelf 16, second shelf 18 and third shelf 20 have the same length 70 and are removably coupled to top components 31, 35 and 39 of first, second and third panels 24, 26 and 28, respectively, and removably coupled to top components 51, 55 and 59 of first, second and third panels 44, 46 and 48, respectively. For example, length 70 can range between approximately 500 and 550 mm. More specifically, length 70 can be approximately 533 mm. Therefore, when assembled, the bottom of first shelf 16 is removably located at first panel height 64 or the first tier, the bottom of second shelf 18 is removably located at second panel height 66 or the second tier (a position that is higher than first shelf 16) and the bottom of third shelf 20 is removably located at third panel height 68 or the third tier (a position that is higher than first shelf 16 and second shelf 18) to form a tiered arrangement. As illustrated more clearly in FIG. 8, length 70 of each shelf substantially corresponds with the height 68 of the third tier or the third panels 28 and 48.

Figure 3:
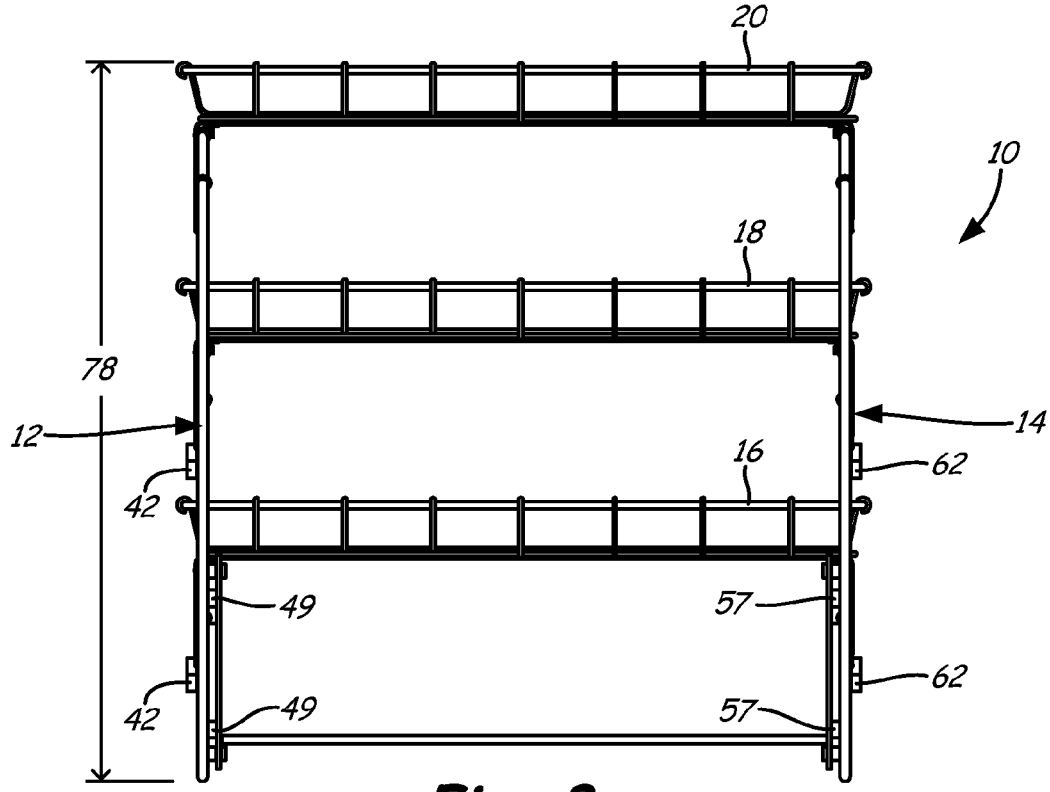
FIG. 3 illustrates a back view of the assembled plant stand illustrated in FIG. 1.

Elongated back support 22 includes a first flanged end 23 and a second flanged end 25. First flanged end 23 is removably coupled to the back component 40 of third panel 28 of first foldable assembly or first support 12 and the second flanged end 25 is removably coupled to the rear component 60 of third panel 48 of second foldable assembly or second support 14. Back support 22 not only locates first foldable assembly or first support 12 a spaced distance 71 (FIG. 1) from second foldable assembly or second support 14, back support 22 also provides strength to plant stand 10 when it is in an assembled state. For example, spaced distance 71 can range between approximately 500 and 550 mm. More specifically, spaced distance can be approximately 516 mm. As illustrated in FIGS. 2 and 3, the length 70 of each of the plurality of shelves 16, 18 and 20 is greater than the spaced distance 71 between first foldable assembly or first support 12 and second foldable assembly or second support 14 in the assembled state. Still further, flanges 23 and 25 provide vertical support to stabilize plant stand 10 during assembly. In particular, flanges 23 and 25 stabilize first support 12 and second support 14 so that they do not collapse before the baskets 16, 18 and 20 can be attached to first support 12 and second support 14.

Figure 8:
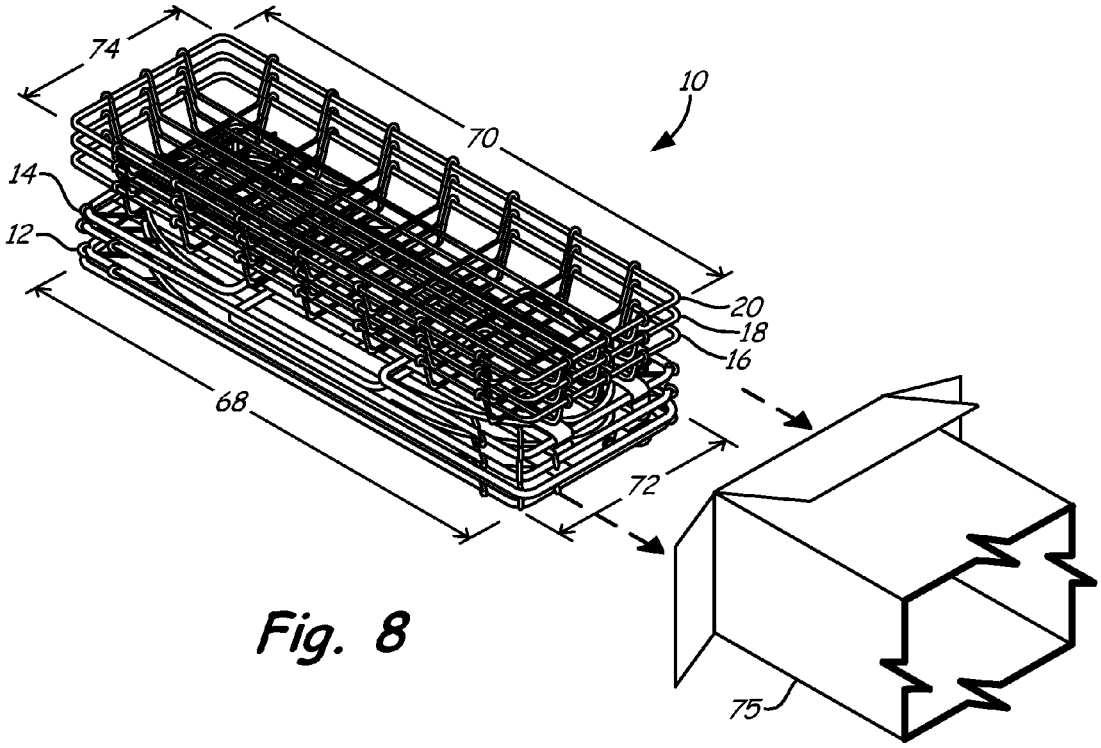
FIG. 8 illustrates a perspective view of the plant stand illustrated in FIG. 1 in a collapsed state including its packaging.
Figure 9:
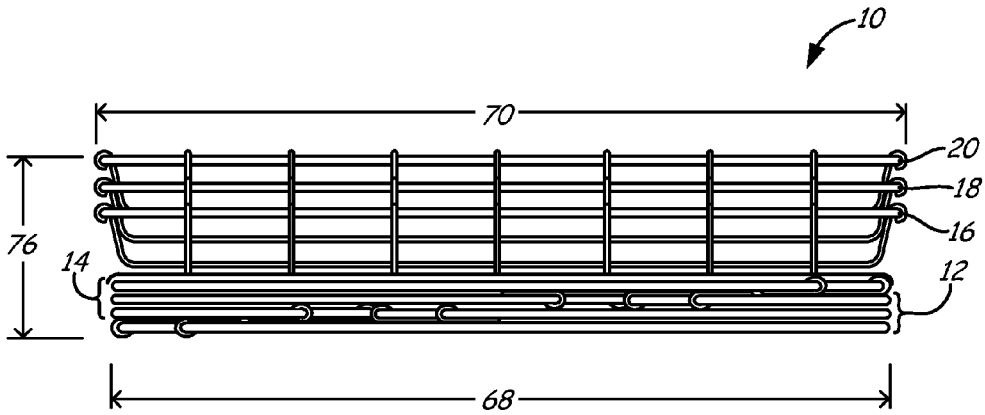
FIG. 9 illustrates a side view of the plant stand illustrated in FIG. 1 in the collapsed state.

FIG. 8 illustrates a perspective view and FIG. 9 illustrates a front view of ready-to-assembly plant stand 10 in a flat pack state according to one embodiment. While FIGS. 8 and 9 illustrate most components of plant stand 10, back support 22 and some components of shelves 16, 18 and 20, such as support bars 82, 84 and 86 (FIG. 11), are not shown for purposes of simplification. In the flat pack state or when disassembled, the plurality of shelves 16, 18 and 20 are nested and the first foldable assembly or first support 12 and the second foldable assembly or second support 14 are folded. In addition, the nested shelves 16, 18 and 20 and the folded first foldable assembly and the folded second foldable assembly are stacked on top of each other to occupy a flat pack height 76. For example, flack pack height can range between approximately 100 and 150 mm. More specifically, flat pack height 76 can be approximately 134 mm. Flat pack height 76 of plant stand 10 is at least 75 percent smaller than the assembled height 78 (FIGS. 2 and 3) of plant stand 10. For example, assembled height 78 can range between approximately 530 and 580 mm. More specifically, assembled height 78 can be approximately 558 mm. In this configuration, height 68 of the third tier or third panel of both first foldable assembly 12 and second foldable assembly 14 occupy a substantially corresponding length that is substantially similar to length 70 of the nested shelves 16, 18 and 20. For example, above height 68 was described as being approximately 520 mm and length 70 was described as being approximately 533 mm. Therefore, length 70 and height 68 do not have to be equal, rather, length 70 and height 68 should substantially correspond such that their difference in dimension is plus or minus approximately 20 mm or less. Furthermore, a width 72 of the folded first foldable assembly or first support 12 and the folded second foldable assembly or second support 14 are substantially similar to a width 74 of the nested shelves. Width 72 is the distance between the front component and the back component of each panel of first foldable assembly or first support 12 and second foldable assembly or second support 14. For example, width 72 can range between approximately 150 and 200 mm. More specifically, width 72 can be approximately 185 mm. In another example, width 74 can range between approximately 150 and 200 mm. More specifically, width 74 can be approximately 183 mm. Therefore, width 72 and width 74 do not have to be equal, rather, width 72 and width 74 should substantially correspond such that their difference in dimension is plus or minus approximately 5 mm or less. As illustrated in FIG. 8, in the flat pack state, plant stand 10 can be inserted into a container 75 for shipping or transporting as shown by the directional arrows.

Figure 10:
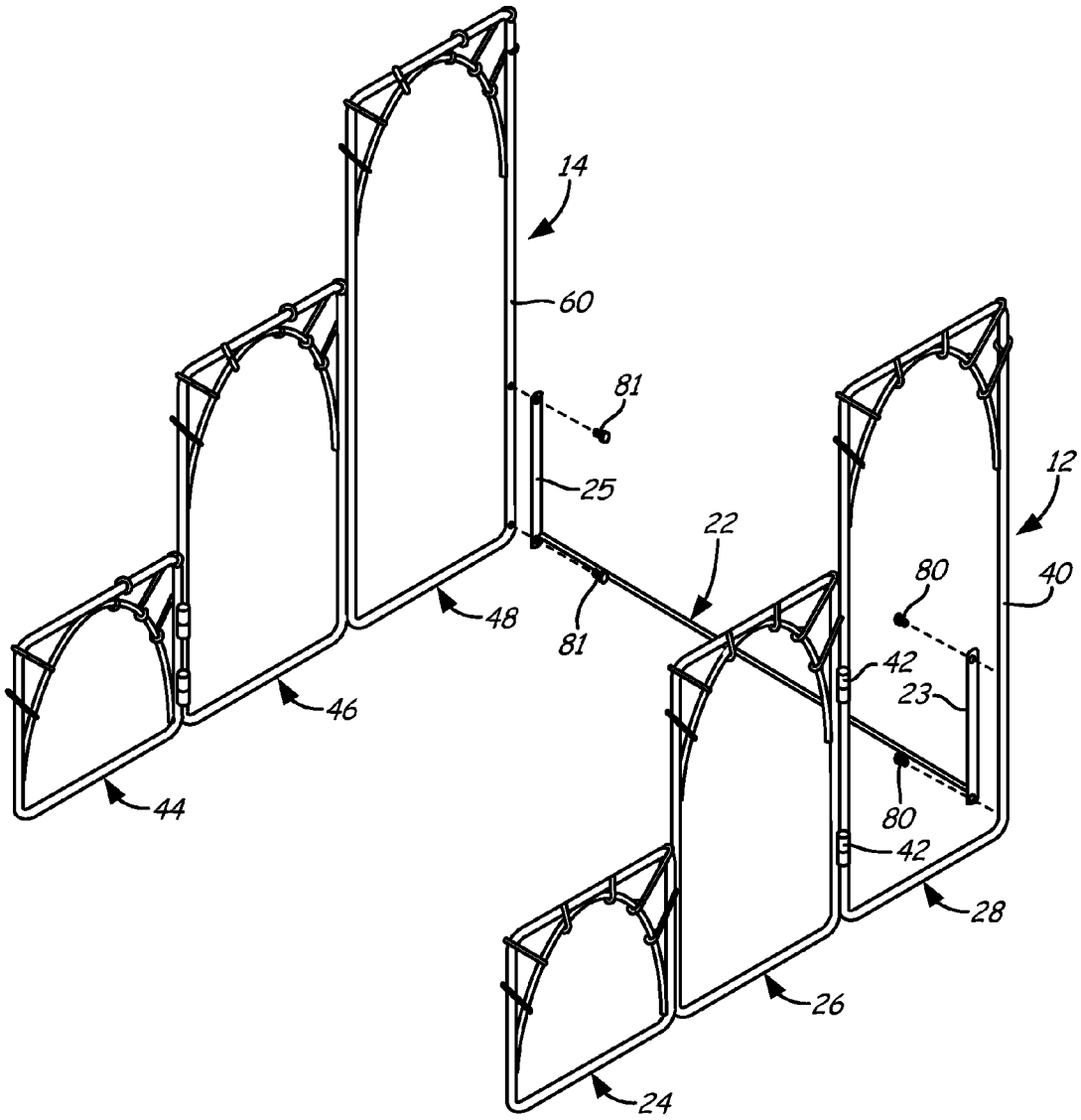
FIG. 10 illustrates a perspective view of one step in a method of assembling the plant stand illustrated in FIG. 1.
Figure 11:
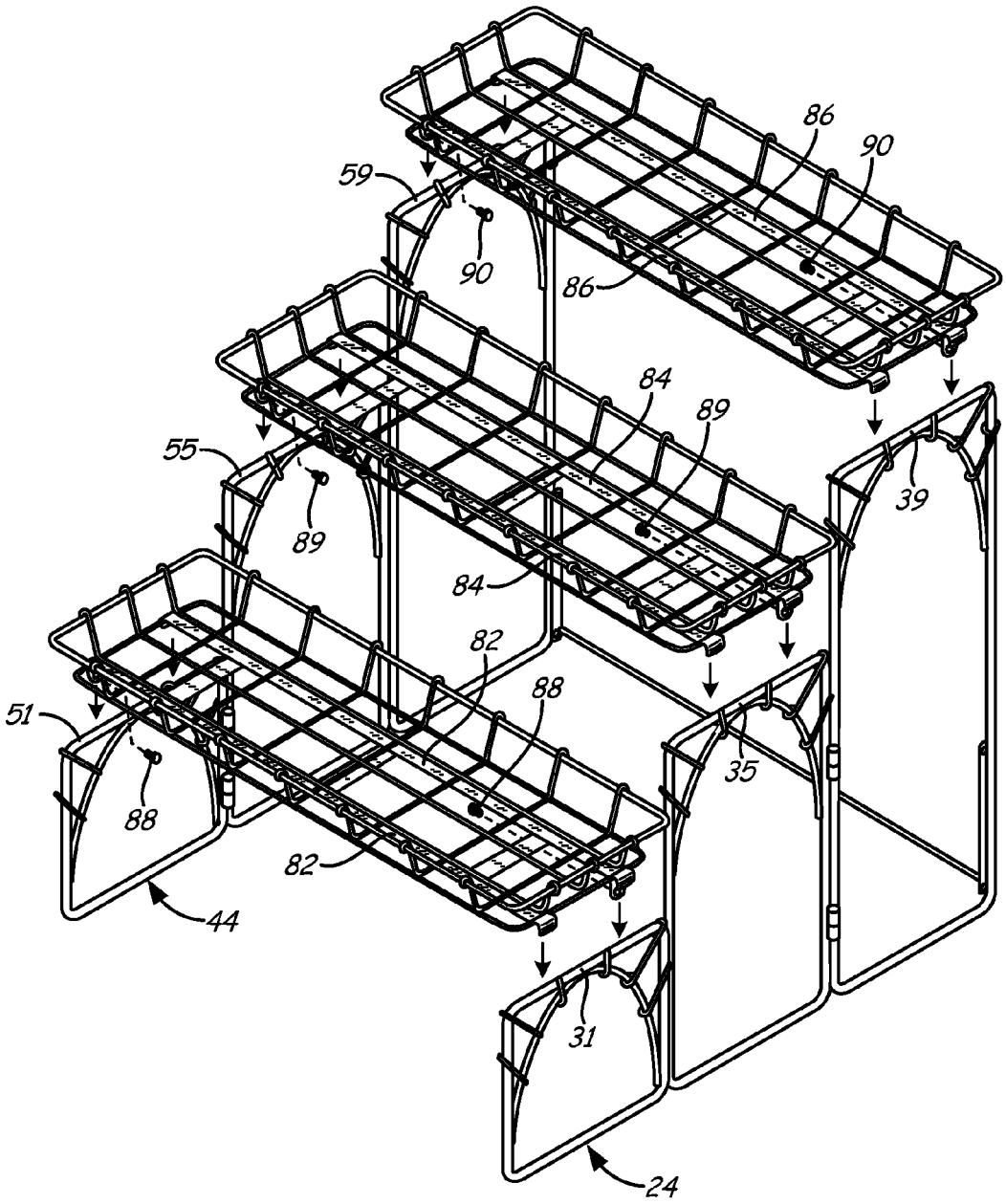
FIG. 11 illustrates a perspective view of another step in a method of assembling the plant stand illustrated in FIG. 1.

FIGS. 10 and 11 illustrate a method of assembling ready-to-assembly plant stand 10. As illustrated in FIG. 10, first foldable assembly or first support 12 and second foldable assembly or second support 14 are unfolded from their flat pack state. In particular, forwardmost first panel 24 is unfolded about hinges 49 from center first panel 26 so that its outer facing surface no longer faces in the opposite direction from the outer facing surface of center first panel 26 and rearwardmost first panel 28 is unfolded about hinges 42 from center first panel 26 so that its inner facing surface no longer faces in the opposite direction from the inner facing surface of center first panel 26. In addition, forwardmost second panel 44 is unfolded about hinges 57 from center second panel 46 so that its outer facing surface no longer faces in the opposite direction from the outer facing surface of center second panel 46 and rearwardmost second panel 48 is unfolded about hinges 62 from center second panel 46 so that its inner facing surface no longer faces in the opposite direction from the inner facing surface of center second panel 46.

Also illustrated in FIG. 10 is the fastening of elongated back support 22 to first foldable assembly or first support 12 and second foldable assembly or second support 14. In particular, first flanged end 23 is fastened to back component 40 of rearwardmost first panel 28 with two fasteners 80 and second flanged end 25 is fastened to back component 60 of rearwardmost second panel 48 with two fasteners 81. Back support 22 provides plant stand 10 with structural stability and positions first foldable assembly or first support 12 a spaced distance 71 from second foldable assembly or second support 14. In this configuration, where elongated back support 22 is fastened to first foldable assembly 12 and second foldable assembly 14, inner facing surfaces of forwardmost panel 24, center panel 26 and rearwardmost panel 28 of first foldable assembly 12 face inner facing surfaces of forwardmost panel 44, center panel 46 and rearwardmost panel 48 of second foldable assembly 14.

As illustrated in FIG. 11, the plurality of shelves 16, 18 and 20 are pulled apart from their nested configuration in the flat pack state and are attached to the top components of each corresponding first panels and second panels of the first foldable assembly or first support 12 and second foldable assembly or second support 14 as shown by the directional arrows. To make the appropriate attachment, each shelf 16, 18 and 20 includes a pair of parallel support bars 82, 84 and 86 that extend the length of each shelf and have downwardly bending ends. These support bars provide a structural component for attaching to top components of the first and second panels.

In particular, first shelf 16 is attached to top component 31 of forwardmost first panel 24 and to top component 51 of forwardmost second panel 44 by coupling two of the right side bent ends of support bars 82 to top component 31 and coupling the opposing two left side bent ends of support bars 82 to top component 51. Two fasteners 88 are used including using one of the fasteners 88 to fasten one of the right side bent ends of one of the support bars 82 to top component 31 and the other fastener 88 to fasten a left side bent end of the other of the support bars 82 to top component 51.

Second shelf 18 is attached to top component 35 of center first panel 26 and to top component 55 of center second panel 46 by coupling two of the right side bent ends of support bars 84 to top component 35 and coupling the opposing two left side bent ends of supports bars 84 to top component 55. Two fasteners 89 are used including using one of the fasteners 89 to fasten one of the right side bent ends of one of the support bars 84 to top component 35 and the other fastener 89 to fasten a left side bent end of the other of the support bars 84 to top component 55.

Third shelf 20 is attached to top component 39 of rearwardmost first panel 28 and to top component 59 of rearwardmost second panel 48 by coupling two of the right side bent ends of support bars 86 to top component 39 and coupling the opposing two left side bent ends of the supports bars 86 to top component 59. Two fasteners 90 are used including using one of the fasteners 90 to fasten one of the right side bent ends of one of the support bars 86 to top component 39 and the other fastener 90 to fasten a left side bent end of the other of the support bars 86 to top component 59.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A plant stand comprising:

a first foldable assembly including a plurality of first panels, each first panel including a front component, a back component, a top component and a bottom component made of a single, continuous material, wherein at least one of the front component and the back component of each first panel is rotatably coupled to at least one of the front component and the back component of an adjacent first panel and wherein a height of each first panel is greater than or less than a height of each first panel to which it is rotatably coupled;

a second foldable assembly including a plurality of second panels, each second panel including a front component, a back component, a top component and a bottom component made of a single continuous material, wherein at least one of the front component and the back component of each second panel is rotatably coupled to at least one of the front component and the back component of an adjacent second panel and wherein a height of each second panel substantially corresponds with the height of one of the first panels of the first foldable assembly;

a plurality of shelves, each shelf configured to be removably coupled to the top component of one of the first panels and the top component of the corresponding second panel such that the plurality of shelves are in a tiered arrangement, wherein a length of each shelf substantially corresponds with the height of a tallest first panel and the height of a corresponding tallest second panel; and a plurality of arc-shaped support members coupled with at least one of the first panels and at least one of the second panels, the arc-shaped supported members being secured directly to the front component, the back component, and the top component of the at least one of the first panels and the at least one of the second panels, respectively.

2. The plant stand of claim 1, wherein the first foldable assembly is located a spaced distance from the second foldable assembly when the plant stand is in an assembled state.

3. The plant stand of claim 2, further comprising a back support having a first end and a second end, wherein the first end fastens to the back component of a rearwardmost first panel of the first foldable assembly and the second end fastens to the back component of a rearwardmost second panel of the second foldable assembly when the plant stand is in the assembled state.

4. The plant stand of claim 2, wherein the length of each shelf is greater than the spaced distance of the first foldable assembly and the second foldable assembly in the assembled state.

5. The plant stand of claim 1, wherein the plurality of shelves comprise same sized baskets capable of nesting together when disassembled from the first foldable assembly and the second foldable assembly.

6. The plant stand of claim 1, wherein each of the plurality of first panels of the first foldable assembly comprise an outer facing surface and an inner facing surface and each of the plurality of second panels of the second foldable assembly comprise an outer facing surface and an inner facing surface, wherein the inner facing surfaces of the first panels face the inner facing surface of the second panels when in an assembled state.

7. The plant stand of claim 6, wherein the first foldable assembly comprises three first panels including a forwardmost first panel, a center first panel and a rearwardmost first panel, wherein the back component of the forwardmost first panel is hinged to the front component of the center first panel such that the outer facing surface of the forwardmost first panel is configured to face away from the outer facing surface of the center first panel when folded and the back component of the center first panel is hinged to the front component of the rearwardmost first panel such that the inner facing surface of the rearwardmost first panel is configured to face away from the inner facing surface of the center first panel when folded.

8. The plant stand of claim 7, wherein the second foldable assembly comprises three second panels including a forwardmost second panel, a center second panel and a rearwardmost second panel, wherein the back component of the forwardmost second panel is hinged to the front component of the center second panel such that the outer facing surface of the forwardmost second panel is configured to face away from the outer facing surface of the center second panel when folded and the back component of the center second panel is hinged to the front component of the rearwardmost second panel such that the inner facing surface of the rearwardmost second panel is configured to face away from the inner facing surface of the center second panel when folded.

9. An article of manufacture comprising:

a first support having a plurality of foldable first panels, wherein each first panel of the first support includes a top and has a respective height;

a second support having a plurality of foldable second panels that correspond with the plurality of foldable first panels of the first support, wherein each second panel includes a top and has a respective height that substantially corresponds with the height of one of the first panels of the first support;

an elongated back support having a first end and a second end, the first end being fastened to a rearwardmost first panel of the first support and the second end being fastened to a rearwardmost second panel of the second support to establish a spaced distance between the first support and the second support;

a plurality of shelves removably attached to respective tops of each corresponding first panel of the first support and second panel of the second support; and a plurality of arc-shaped support members coupled with the plurality of foldable first panels and the plurality of foldable second panels, the arc-shaped support members being secured directly to the respective tops and directly to front and back sides of each corresponding first panel of the first support and second panel of the second support, wherein a length of each shelf in the plurality of shelves substantially corresponds with the height of a tallest first panel and the height of a corresponding tallest second panel.

10. The article of manufacture of claim 9, wherein the first support, the second support and the plurality of shelves are configured into one of a flat pack state having a flat pack height and an assembled state having an assembled height, the flat pack height being at least 75 percent smaller than the assembled height, and wherein in the flat pack state the plurality of shelves are nested together.

11. The article of manufacture of claim 10, wherein the height of a forwardmost first panel is less than the height of a center first panel and the height of the center first panel is less than the height of the rearwardmost first panel.

12. The article of manufacture of claim 11, wherein the height of a forwardmost second panel is less than the height of a center second panel and the height of the center second panel is less than the height of the rearwardmost second panel.

13. The article of manufacture of claim 12, wherein in the assembled state the plurality of shelves comprise a first shelf removably attached to the top of the forwardmost first panel and to the top of the forwardmost second panel, a second shelf removably attached to the top of the center first panel and the top of the center second panel and a third shelf removably attached to the top of the rearwardmost first panel and the top of the rearwardmost second panel such that the first shelf, the second shelf and the third shelf are in a tiered arrangement in the assembled state.

14. The article of manufacture of claim 12, wherein in the flat pack state the forwardmost first panel is folded against the center first panel, the rearwardmost first panel is folded against the center first panel, the forwardmost second panel is folded against the center second panel and the rearwardmost second panel is folded against the center second panel.

* * * * *